US007264245B2

(12) United States Patent
Cho

(10) Patent No.: US 7,264,245 B2
(45) Date of Patent: Sep. 4, 2007

(54) PORTABLE BALL RETRIEVER

(76) Inventor: Kwang Han Cho, 148 S. Gramercy Pl., #16, Los Angeles, CA (US) 90004

( * ) Notice: Subject to any disclaimer, the term of this patent is extended or adjusted under 35 U.S.C. 154(b) by 0 days.

(21) Appl. No.: 10/904,942

(22) Filed: Dec. 6, 2004

(65) Prior Publication Data

US 2006/0119045 A1 Jun. 8, 2006

(51) Int. Cl.
*A63B 69/00* (2006.01)
*A63B 63/00* (2006.01)

(52) U.S. Cl. ..... 273/396; 473/434; 473/454

(58) Field of Classification Search ..... 273/398–402, 273/395, 396; 473/476, 478, 434, 435, 454–456
See application file for complete search history.

(56) References Cited

U.S. PATENT DOCUMENTS 3,427,026 A * 2/1969 Mahoney ..... 473/435
3,672,672 A * 6/1972 Rubin ..... 473/435
4,489,941 A * 12/1984 Shieh ..... 473/197
4,553,751 A * 11/1985 Ketchum ..... 473/435
5,039,109 A * 8/1991 Mahoney et al. ..... 473/435
5,549,304 A * 8/1996 Davis ..... 273/396
5,569,094 A * 10/1996 Macaluso ..... 473/197
D403,386 S 12/1998 Cho
5,976,023 A 11/1999 Cho
D418,883 S 1/2000 Cho
6,135,894 A 10/2000 Cho
6,165,085 A * 12/2000 Lubin ..... 473/478
D441,040 S 4/2001 Cho
6,312,343 B1 11/2001 Cho
6,554,717 B2 4/2003 Cho
7,021,630 B1 * 4/2006 Cho ..... 273/401
2003/0060309 A1 * 3/2003 Smith ..... 473/431
2003/0203775 A1 10/2003 Wong

* cited by examiner

*Primary Examiner*—Mark S. Graham
(74) *Attorney, Agent, or Firm*—Park Law Firm; John K. Park

(57) ABSTRACT

A ball retriever comprising a main member forming a first closed loop, a base member forming a second closed loop with the main member foldably attached to the base member, a fabric portion smaller in area than a spatial plane defined by the first loop, straps connecting the fabric portion to the main member, and a support to sustain the main member against the base member while maintaining a substantial angle between the main member and the base member.

18 Claims, 3 Drawing Sheets

PORTABLE BALL RETRIEVER

BACKGROUND OF THE INVENTION

This invention relates to an athletic ball retrieving net. More specifically, the present invention relates to an improved portable ball retriever enhancing ball recollecting characteristics where a person throwing a ball to practice can easily catch the return ball on the spot of the throwing without allowing the ball to bounce on the ground.

Conventional athletic ball game nets typically focus on catching balls to facilitate ball games in a limited area. For example, a portable net is used indoors to catch a chip shot for golf practice.

A demand on the market is to provide a practice net that enables a ball throwing practice using, for example, a single ball. The market demand may be met if a ball thrown off from a person can be easily caught by the same person who sticks where he stands. Further, if the person throwing a ball can catch the same ball in return, it would be a significant advantage to those that still want to practice a ball throwing game alone in a place like a backyard or a patio. A strong demand is a portable practice net that bounces a ball back to a person who threw the ball.

SUMMARY OF THE INVENTION

The present invention is contrived to overcome the conventional disadvantages. Accordingly, it is an object of the present invention to provide a portable ball retriever enhancing ball recollecting characteristics by applying a strap tying mechanism between a net and a frame.

Another object is to enable a person throwing a ball for practice to easily catch the return ball on the spot of the throwing without allowing the ball to bounce on the ground.

A further object is to stabilize the ball retriever by employing a cross-tying mechanism to maintain balance of the retriever without regard to the ball speed.

To achieve these and other objects, the portable ball retriever according to the present invention comprises a main member forming a first closed loop, a base member forming a second closed loop where the main member is foldably attached to the base member, a fabric portion smaller in area than a spatial plane defined by the first loop, a plurality of straps connecting the fabric portion to the main member, and a first support to sustain the main member against the base member while maintaining a substantial angle between the main member and the base member.

In an embodiment, each end of the straps is detachably attached by a hook to an outer periphery of the fabric portion. For a better performance, a second support to balance the main member against the base member.

The second support is a pair of strings fastening the main member to the base member relative the first support where each end of the strings is attached to an upper portion of the main member and to a rear portion of the base member. The strings are formed to cross against each other and each formed to elastically tie the main member to base member.

The straps may be formed elastic, and the fabric portion may be formed of a net. A fabric retainer in a patch format is attachedly sided to each corner of the main and base members. Further, a fabric cover is attachedly sided to the main member so as to substantially cover the straps and each space between the straps.

The main and base members are each coilable. Preferably, the main and base members are each coilable to overlapping loops. A fabric patch attachedly sided to the main and base members has a support sleeve through which to receive the first support.

In a better version the ball retriever comprises a main sleeve substantially covering the main member; and a base sleeve substantially covering the base member. The main sleeve has main holes and the base sleeve has base holes, so the main and base holes removably carry therein ends of the first support.

The first support is a pair of rods whose ends become removably, correspondingly carried in the main and base holes. The rods are elastically detachable to two pieces which remain connected by an elastic string provided in the respective rods.

The advantages of the present invention are numerous. Most of all, the fabric portion or net of the ball retriever is pulled by the straps toward the main member to further tighten the fabric portion so as to maximize the ball retrieving or bouncing characteristics, thereby enhancing utility and marketability. In addition, the second support or strings elastically tying the main member to the base member in a cross format serves to further stabilize posture of the ball retriever in combination with the first support or the rods, especially when catching a speed ball, thereby improving product reliability. Further, the pair of coilable main and base members are foldably connected to each other and coilably overlapped in multiple loops, respectively, thereby further facilitating storage, assembly and disassembly of the ball retriever. Still further, the patch sleeve receiving therethrough the supporting member together with each the substantial polygonal format of the main and base members secures stability of the main member against the base member, thereby enhancing user satisfaction.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
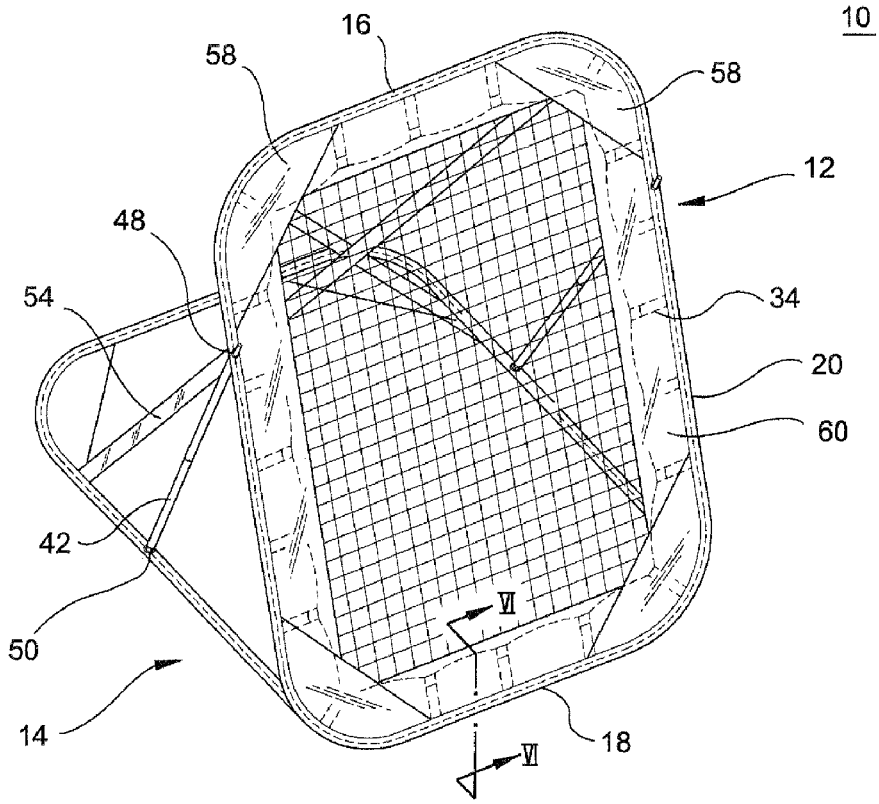
FIG. 1 is a perspective view illustrating a portable ball retriever according to the present invention.
Figure 2:
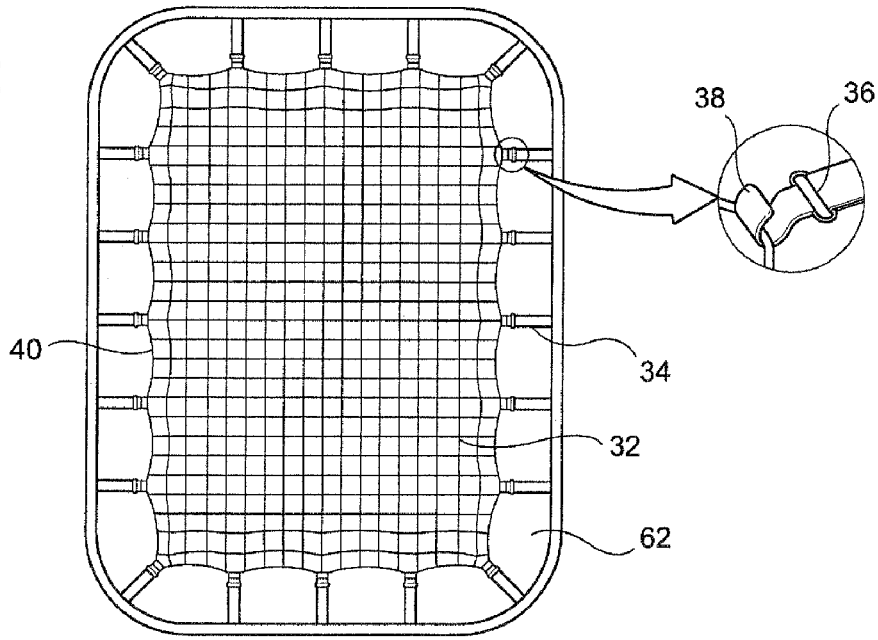
FIG. 2 is a schematic front view of FIG. 1.
Figure 3:
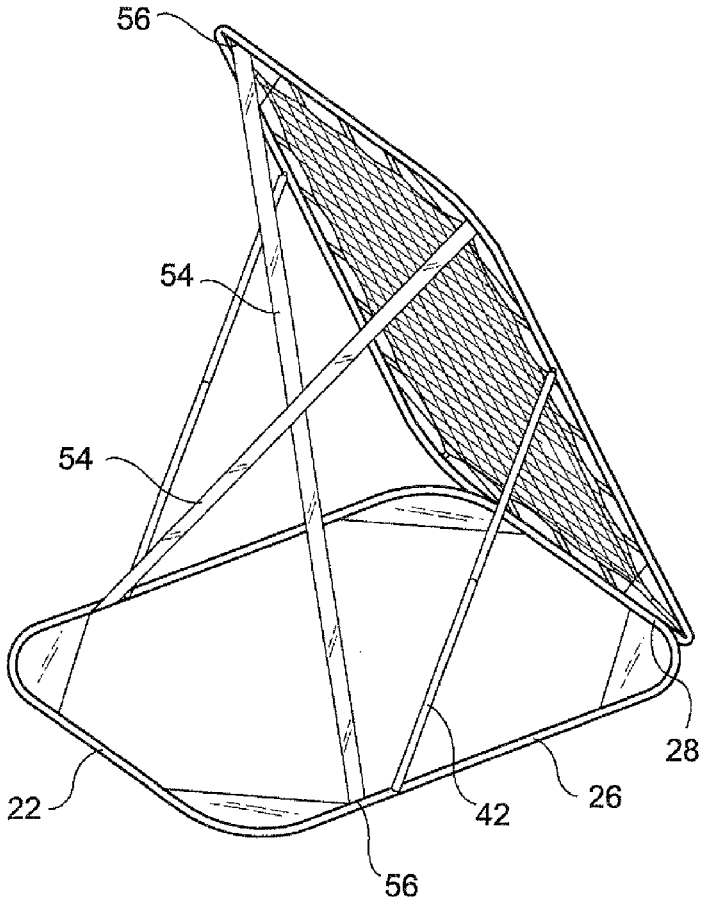
FIG. 3 is a perspective side view showing a supporting mechanism of the ball retriever.
Figure 4:
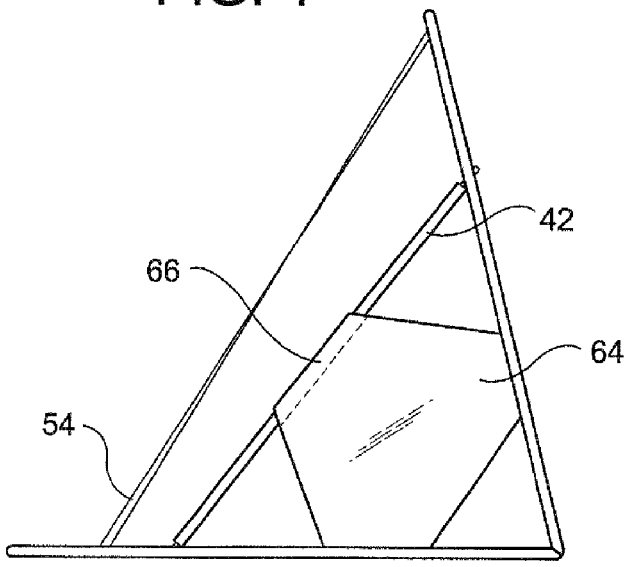
FIG. 4 is a schematic side view of the ball retriever with a fabric patch.

FIGS. 1-4 each show a portable ball retriever 10 according to the present invention in a perspective view, a front view and side views. As shown therein, the portable ball retriever 10 comprises a main member 12 forming a first closed loop 13, and a base member 14 forming a second closed loop 15. The main member 12 is foldably attached to the base member 14. In order to match with the main member 12, a base member 14 is provided to form the second closed loop 15 in a substantially similar format to the main member 12.

The main member 12 is defined by top, bottom and side sections 16, 18, 20, and the base member 14 is defined by rear, front and side sections 22, 24, 26. In this construction, the main member bottom section 18 is attached to the base member front section 24 so that the main member 12 can be angularly raised against the base member 14 while maintaining a partial attachment of the main and base members 12, 14.

Figure 6:
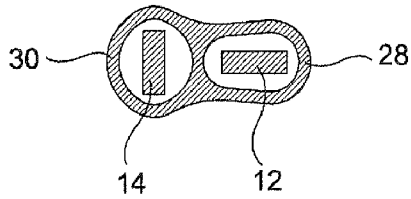
FIG. 6 is a cross-sectional view taken along line VI-VI in FIG. 1.

Meanwhile, FIG. 6 shows a cross-section taken along VI-VI in FIG. 1. As wherein therein, the main and base members 12, 14 are each fabric-covered so that the main member 12 is carried in a main sleeve 28, and the base member 14 is carried in the base sleeve 30. Specifically, the main sleeve 28 substantially covers the main member 12; and the base sleeve 30 substantially covers the base member 14. Here, the main sleeve 28 has main holes 48 and the base sleeve 30 has base holes 50.

Inside the main member 12 there is provided a fabric portion 32 which is smaller in area than a spatial plane defined by the first loop 13. The fabric portion 32 may form a net or a net fabrication where threads are interwoven or knotted together to form a plurality of meshes. The fabric portion 32 may be formed of a material such as synthetic cloth or natural cloth.

In order for the fabric portion 32 to function to the best of the ball retriever 10 there are provided a plurality of straps 34 connecting the fabric portion 32 to the main member 12. For a better performance, each end 36 of the straps 34 is detachably attached by a hook 38 to an outer periphery 40 of the fabric portion 32. The straps 34 are preferably elastic and formed of elastic material. In this construction, elasticity of the fabric portion 32 can be easily adjusted by hook control. For example, when the fabric portion 32 needs to be further tightened, the hook 38 can hook up more of the fabric portion 32 or the net to improve the ball bouncing or return characteristics.

Figure 5:
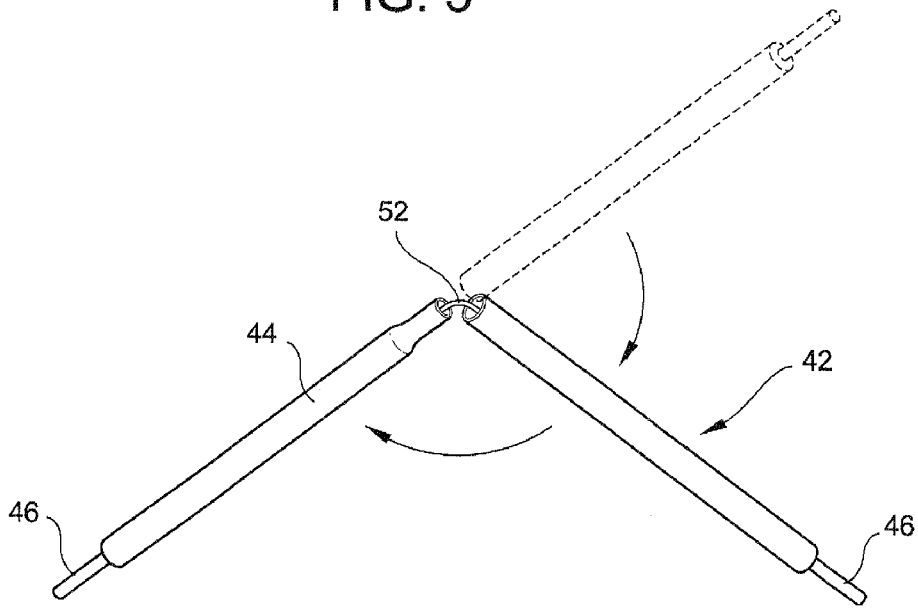
FIG. 5 is a construction view showing a first support in FIG. 1.

With reference to FIG. 5, to stabilize the upward posture of the main member 12, the ball retriever 10 also comprises a first support 42 to sustain the main member 12 against the base member 14 while maintaining a substantial angle between the main and base members 12, 14. Here, the main and base members 12, 14 are rotably attached to each other around the respective bottom and front sections 18, 24 of the main and base member 12, 14. In this mode, the ends 46 of the first support 42 are removably carried in the main and base holes 48, 50. Namely, the first support 42 is formed of a pair of rods 44 whose ends 46 become removably, correspondingly carried in the main and base holes 48, 50.

In a preferred version, the rods 44 are each elastically detachable to two pieces which remain connected by an elastic string 52 provided in the respective rods 44. This way, the first support 42 can be easily dissembled to the smaller pieces to facilitate storage.

To improve the product reliability, the ball retriever 10 further comprises a second support 54 to balance the main member 12 against the base member 14. The second support 54 is preferably formed of a pair of strings fastening the main member 12 to the base member 14 relative the first support 42. Here, each end 56 of the strings 54 is attached to the upper portion 16 of the main member and to a rear portion 22 of the base member 14. The strings 54 are preferably formed to cross against each other. That is, one of the strings 54 is diagonally formed from an upper left corner of the main member 12 to a lower right corner of the base member 14 whereas the other of the strings 54 is also diagonally formed to cross the first of the strings 54 from an upper right corner of the main member 12 to a lower left corner of the base member 14. Consequently, the strings or the second support 54 are each formed to elastically tie the main member 12 to the base member 14.

Further provided is a fabric retainer 58 in a patch format so that the fabric retainer is attachedly sided to each corner of the main and base members 12, 14. Specifically, the main member 12 has a plurality of corners each in arc so as to shape the first closed loop 13 in a substantial polygon, and the base member 14 has a plurality of corners each in arc so as to shape the second closed loop 15 in a substantial polygon. To realize each polygonal formation of the main and base members 12, 14 the ball retriever 10 comprises the fabric retainer 58 formed adjacent to each of the corners so as to maintain the polygon in shape. The best mode of the polygonal formation is a substantial square format.

The ball retriever 10 further comprises a fabric cover 60 attachedly sided to the main member 12 so as to substantially cover the straps 34 and each space 62 between the straps 34. The fabric cover 60 serves to prevent a practice ball from passing through the space 62 between the straps 34.

Together with the first support 42 there is provided a fabric patch 64 to secure a desired angle between the main and base members 12, 14 while enhancing stability of the raised-up posture of the main member 12 against the base member 14. The fabric patch 64 is attachedly sided to the main and base members 12, 14 around each bottom and front section 18, 24 of the main and base members 12, 14. Preferably, the fabric patch 64 has a support sleeve 66 to allow passage of the first support 42 while providing an additional stability to the first support 42. With the fabric patch 64 provided in the ball retriever 10, the preferred angle by the main and base member 12, 14 is between about 40 degrees and slightly less than 90 degrees so that the main and base members 12, 14 can be maintained at a substantially erected but tilted position.

Figure 7:
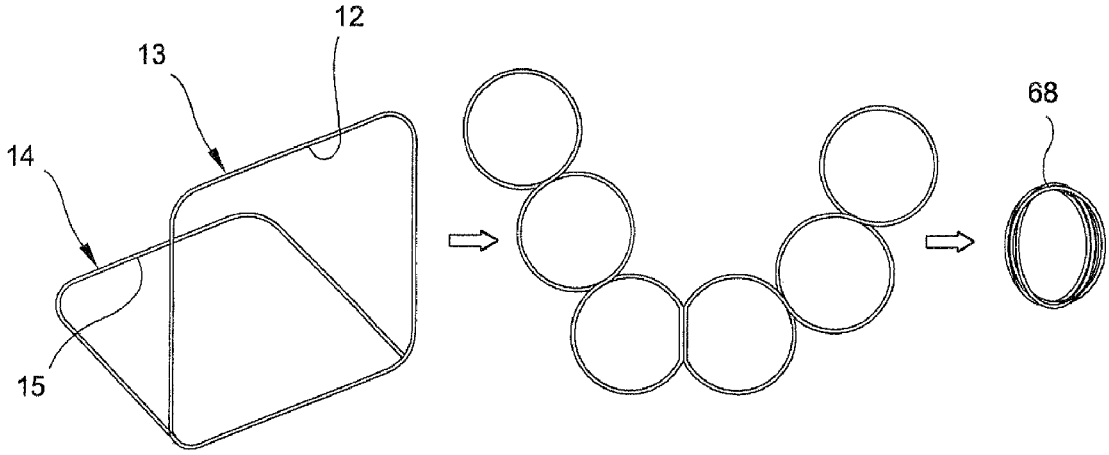
FIG. 7 is a schematic view showing a coiling mechanism of the portable ball retriever.

FIG. 7 shows a storage mechanism applied to the ball retriever 10. As shown therein, for better storage and dissembling purposes, the main and base members 12, 14 are each formed in a coilable format so that the main and base members 12, 14 are each coilable to overlapping loops 68. Preferably, the main and base members 12, 14 are each coiled in twofold or threefold to the overlapping loops 68 to facilitate storage and portability. For assembly into the usable ball retriever 10, the overlapped loops 68 can be simply released for elastic pop-up setting to the polygonal formation. Then, the main member 12 is raised and supported by the first support 42 selectively carried in the support sleeve 66. In the step of assembly, the second support 54 or the strings serves to cooperation with the first support 42. That is, the first support 42 pushes up the main member 12 against the base member 14 whereas the second support 54 elastically pulls down the main member 12 toward the base member 14 so as to stabilize the overall posture of the ball retriever 10 regardless of the speed of the ball being thrown at the fabric portion 32. The second support 54 is preferably fixed to the main and base members 12, 14.

The main and base members 12, 14 may be formed of an elastic material so as to facilitate the assembly and the coiled overlapping for disassembly. For disassembly of the ball retriever 10, the first support 42 can be simply removed, and the main and base members 12, 14 are twisted and coiled into a plurality of overlapping loops 68. Accordingly, the pair of coiled main and base members 12, 20 can be easily stored in the storage bag (not shown).

As discussed above, an advantage of the present invention is that the fabric portion 32 or net of the ball retriever 10 is pulled by the straps 34 toward the main member 12 to further tighten the fabric portion 32 so as to maximize the ball retrieving or bouncing characteristics, thereby enhancing utility and marketability. In addition, the second support 54 or strings elastically tying the main member 12 to the base member 14 in a cross format serves to further stabilize posture of the ball retriever 10 in combination with the first support 42 or the rods 44, especially when catching a speed ball, thereby improving product reliability.

Further, the pair of coilable main and base members 12, 14 are foldably connected to each other and coilably overlapped in multiple loops, respectively, thereby further facilitating storage, assembly and disassembly of the ball retriever. Still further, the support sleeve 66 receiving therethrough the first support 42 in combination with the substantial polygonal format of the main and base members 12, 14 secures stability of the main member 12 against the base member 14, thereby enhancing user satisfaction.

Although the present invention has been described in considerable detail with reference to certain preferred versions thereof, other versions are possible by converting the aforementioned construction. Therefore, the scope of the invention shall not be limited by the specification specified above and the appended claims.

What is claimed is:

1. A portable ball retriever comprising:

a) a main member forming a first closed loop;

b) a base member forming a second closed loop, wherein the main member is foldably attached to the base member;

c) a fabric portion smaller in area than a spatial plane defined by the first loop;

d) a plurality of straps connecting the fabric portion to the main member;

e) a first support to sustain the main member against the base member while maintaining a substantial angle between the main member and the base member;

f) a second support to balance the main member against the base member, wherein the second support elastically ties the main member to the base member propped by the first support;

g) a fabric patch attachedly sided to the main and base members, wherein the fabric patch has a support sleeve through which to receive the first support; and h) a fabric cover attachedly sided to the main member so as to substantially cover the straps and each space between the straps;

wherein the main member comprises a top section, a bottom section, and two side sections, wherein the fabric cover is attachedly sided to the top section, bottom section and side sections of the main member, wherein the straps are elastic, wherein the fabric portion is a net.

2. The ball retriever of claim 1 further comprising a fabric retainer in a patch format, wherein the fabric retainer is attachedly sided to each corner of the main and base members.

3. The ball retriever of claim 1 wherein the main and base members are each coilable.

4. The ball retriever of claim 3 wherein the main and base members are each coilable to overlapping loops.

5. The ball retriever of claim 1 further comprising:

a) a main sleeve substantially covering the main member; and b) a base sleeve substantially covering the base member.

6. The ball retriever of claim 5 wherein the main sleeve has main holes and the base sleeve has base holes, wherein the main and base holes removably carry therein ends of the first support.

7. The ball retriever of claim 1 wherein the first support is a pair of rods whose ends become removably, correspondingly carried in the main and base holes.

8. The ball retriever of claim 7 wherein the rods are elastically detachable to two pieces which remain connected by an elastic string provided in the respective rods.

9. The ball retriever of claim 1 wherein the second support is a pair of strings fastening the main member to the base member relative the first support, wherein each end of the strings is attached to an upper portion of the main member and to a rear portion of the base member.

10. The ball retriever of claim 9 wherein the strings are formed to cross against each other.

11. A portable ball retrieving device comprising:

a) a main member forming a first closed loop;

b) a base member forming a second closed loop, wherein the main member is foldably attached to the base member;

c) a fabric portion smaller in area than a spatial plane defined by the first loop;

d) a plurality of straps connecting the fabric portion to the main member, wherein each end of the straps is detachably attached by a hook to an outer periphery of the fabric portion;

e) a first support to sustain the main member against the base member while maintaining a substantial angle between the main member and the base member;

f) a second support to balance the main member against the base member, wherein the second support elastically ties the main member to the base member propped by the first support;

g) a fabric patch attachedly sided to the main and base members, wherein the fabric patch has a support sleeve through which to receive the first support; and h) a fabric cover attachedly sided to the main member so as to substantially cover the straps and each space between the straps;

wherein the main member comprises a top section, a bottom section, and two side sections, wherein the fabric cover is attachedly sided to the top section, bottom section and side sections of the main member, wherein the straps are elastic, wherein the fabric portion is a net.

12. The ball retriever of claim 11 further comprising a fabric retainer in a patch format, wherein the fabric retainer is attachedly sided to each corner of the main and base members.

13. The ball retriever of claim 11 wherein the main and base members are each coilable.

14. The ball retriever of claim 13 wherein the main and base members are each coilable to overlapping loops.

15. The ball retriever of claim 11 further comprising:

a) a main sleeve substantially covering the main member; and b) a base sleeve substantially covering the base member.

16. The ball retriever of claim 15 wherein the main sleeve has main holes and the base sleeve has base holes, wherein the main and base holes removably carry therein ends of the first support.

17. The ball retriever of claim 11 wherein the first support is a pair of rods whose ends become removably, correspondingly carried in the main and base holes.

18. The ball retriever of claim 17 wherein the rods are elastically detachable to two pieces which remain connected by an elastic string provided in the respective rods.

* * * * *